United States Patent [19]

Ross et al.

[11] Patent Number: 4,576,196

[45] **Date of Patent: * Mar. 18, 1986**

[54] UNLOADING INJECTION CONTROL VALVE

[75] Inventors: Richard J. Ross; David J. Speller, both of Houston, Tex.

[73] Assignee: Baker Oil Tools, Inc., Orange, Calif.

[ * ] Notice: The portion of the term of this patent subsequent to Nov. 12, 2002 has been disclaimed.

[21] Appl. No.: 704,606

[22] Filed: Feb. 25, 1985

Related U.S. Application Data

[63] Continuation-in-part of Ser. No. 535,409, Sep. 26, 1983.

[51] Int. Cl.[4] ..... F16K 31/12

[52] U.S. Cl. ..... 137/508; 251/325; 166/318; 166/319; 166/321

[58] Field of Search ..... 166/141, 142, 145, 150, 166/151, 183–186, 188, 319, 321, 324, 325; 251/325, 333; 137/508

[56] References Cited

U.S. PATENT DOCUMENTS

| | | | |
|---|---|---|---|
| 2,311,212 | 2/1943 | Coberly | 166/1 |
| 3,193,016 | 7/1965 | Knox | 166/325 X |
| 3,750,752 | 8/1973 | Mott | 166/224 R |
| 4,316,504 | 2/1982 | Baker et al. | 166/53 |
| 4,332,298 | 6/1982 | Kuus et al. | 166/319 |
| 4,481,973 | 11/1984 | O'Brien et al. | 137/469 |

*Primary Examiner*—Samuel Scott
*Assistant Examiner*—Allen J. Flanigan
*Attorney, Agent, or Firm*—Norvell & Associates

[57] ABSTRACT

A valving apparatus for use in controlling the fluid pressure in a subterranean well conduit and in the annulus surrounding the conduit is disclosed. The valving apparatus is of the shuttle type and is shiftable between a closed position and an open position allowing flow within the tubing by the application of fluid pressure in the tubing above the valve. Pressure equalization below the valve is provided when the valve is in the closed position thus permitting the apparatus to be used with well tools in which annulus and tubing pressure must be equalized. A plug selectively inserted within the valve apparatus prevents the flow of fluids through the conduit in one direction and permits the build up of said fluid pressure. An annular fluid bypass does permit flow around the plug when the valve is shifted to the open position. An annular elastomeric sealing mass cooperates with a relatively movable annular ridge to provide sealing action for the valving apparatus.

11 Claims, 10 Drawing Figures

UNLOADING INJECTION CONTROL VALVE

RELATIONSHIP TO OTHER PENDING APPLICATIONS

This application constitutes a continuation-in-part of co-pending application Ser. No. 535,409, filed 9/26/83, and entitled "Unloading Injection Control Valve."

BACKGROUND OF THE INVENTION

1. Field of the Invention

The invention relates to a valve apparatus for use in a subterranean fluid transmission conduit or work string in which fluid pressure above the valving apparatus can be used to open the valve to permit fluid pressure to act at a location below the valve.

2. Description of the Prior Art

There are many downhole tools and operations which require the injection of fluid through a tubing conduit to the producing formation or some other location within the well, or which require the use of fluid pressure applied through the tubing. For example, washing or acidizing operations require fluid injection through the tubing bore. Some tools also incorporate fluid pressure actuated expandable packing elements which are expanded into sealing engagement with the wall of the casing upon the application of fluid pressure within the tubing or the tool bore.

Such tubing pressure dependent operations of well tools generally not only require the injection of fluids through the tubing bore or the application of pressure within the tubing, but often require control over the relative fluid pressures in the tubing and in the annulus between the tubing and the well bore or casing. For example, the pressure actuation of the downhole tool, such as a tool having expandable packing elements, may be dependent upon the force generated by the pressure differential existing between the tubing bore and the annulus. To set or expand the packing elements, the pressure in the tubing, in general, must exceed the pressure in the adjacent portion of the annulus. Conversely to permit the expanded packing elements to relax, the pressure in the tubing bore must generally be less than the pressure in the annulus. In low fluid level wells, the annulus fluid pressure may be continuously less than the hydrostatic pressure in the fluid transmission conduit or work string. Thus any operation dependent upon a greater pressure in the annulus than in the tubing would be difficult to perform. For example, a well tool having an expandable packing element actuated by excess fluid pressure in the tubing may be difficult to retract when tubing pressure is reduced, because the hydrostatic pressure in the tubing will still exceed the pressure acting on the packing elements in the annulus. Similarly, the excess pressure differential in the tubing may prevent the movement of a tool having a cup-type packing element because of the pressure difference between the tubing and the annulus.

A simple, reliable apparatus for controlling the pressure in the tubing and in the annulus of certain wells, such as wells having a low fluid level, and for equalizing the pressure between the tubing and the annulus is therefore highly desirable. It is therefore an object of this invention to provide such a tool especially adapted for use in low fluid level wells, and particularly a tool that is essentially frictionless and can withstand opening of the valving elements under a substantial pressure differential.

SUMMARY OF THE INVENTION

A valving apparatus for use in a fluid transmission conduit, such as a tubing or work string, in a subterranean well, such as an oil or gas well, employs fluid pressure changes within the tubing to operate the valve. The valve employs a plug selectively mounted within the bore of the valving apparatus to prevent the continuous flow of fluid through the bore of the valving appratus in one direction, generally downward. An annular fluid bypass communicable with the bore of the valving apparatus and of the well conduit above and below the plug provides a means of transmitting fluid through the conduit and valving apparatus when the valve is in the open position.

A shuttle valve shiftable relative to the plug opens and closes an annular fluid communication path between the fluid bypass and the bore of the valving apparatus on one side of the plug. For example, in the preferred embodiment of this invention, the shiftable shuttle valve opens and closes the fluid communication path below the plug. Fluid can then be injected through the upper fluid transmission conduit then through the annular fluid bypass and into the valve apparatus and fluid transmission conduit below the plug.

Normally, the shuttle valve in the preferred embodiment of the invention is spring biased to a closed position preventing the flow of fluids from the surface of the well to a subsurface location below the plug. In the preferred embodiment of this invention, the spring-loaded shuttle valve includes a separate communication path or radial port permitting fluid communication between the annulus surrounding the valving apparatus and the tubing below the plug when the shuttle valve is in the closed position. Again in the preferred embodiment, actuation of the shuttle valve to move the valve to the open position also closes the radial path permitting pressure unloading or equalization between the lower tubing and the annulus. When pressure is reduced in the tubing string above the plug, the shuttle valve closes the fluid communication path through the tubing and again opens the annular radial port permitting communication between the annulus and the lower fluid transmission conduit to equalize the fluid pressures.

The sealing elements of the shuttle valve comprise an annular elastomeric mass on each end of the shuttle valve in which annular ridges are respectively embedded in the closed and open positions of the shuttle valve.

DESCRIPTION OF PREFERRED EMBODIMENT

Figure 1:
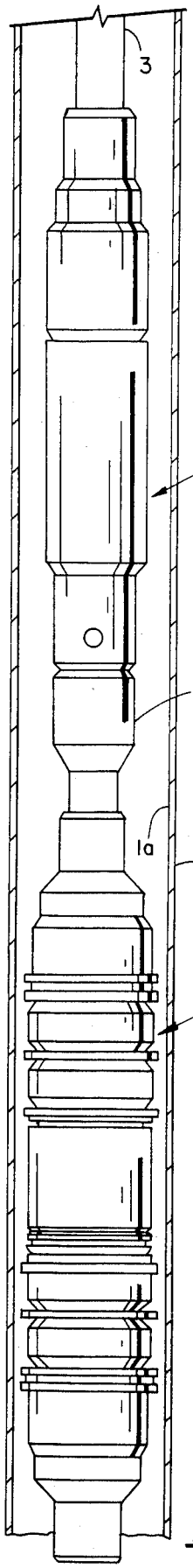
FIG. 1 is a schematic elevational view of a valving apparatus involving this invention, shown in assembled relationship to a perforation washer and mounted within the casing of a well.

The valving apparatus involving this invention may be employed for controlling the application of fluid pressure for the injection of fluids in a number of completions in a subterranean well. For example, fluid pressure may be applied to expandable packing elements disposed in an annulus defined between two concentric well conduits.

For simplicity, the invention will be described in connection with the control of fluid pressure to a conventional perforation washer 20 which is suspended on the end of the valving apparatus 10 and inserted within the well casing 1 by a tubular work string or fluid transmission conduit 3. These elements define an annulus 1*a* between the inner wall of the casing 1 and the outer wall of the interconnected apparatus including perforation washer 20, valving apparatus 10, and tubular work string 3.

Referring now to the enlarged scale drawings of FIGS. 2A–2D, the valving apparatus 10 will be seen to comprise a tubular body assemblage formed by the threaded interconnection of an upper body element or mandrel 101, three intermediate body elements 111, 121, and 131, and a lower body element 141. Mandrel 101 is provided at its upper end with internal threads 102 for connection to the tubular work string 3 or any other suitable well conduit. Mandrel 101 is further provided on its medial portion with external threads 103 for threadably receiving the upper end of the intermediate body element 111. This threaded juncture is sealed by an O-ring seal 103*a*. Intermediate body member 111 is provided at its lower end with external threads 111*d* for threadable attachment to the top end of the second intermediate body element 121. The bottom portion of the intermediate body element 121 is provided with external threads 121*e* for threadable connection to the third intermediate body element 131. The bottom end of intermediate body element 131 is provided with threads 131*e* for connection to the lower body element 141. Body element 141 has threads (not shown) connecting to the top end of the perforation washer unit 20.

Figure 4:
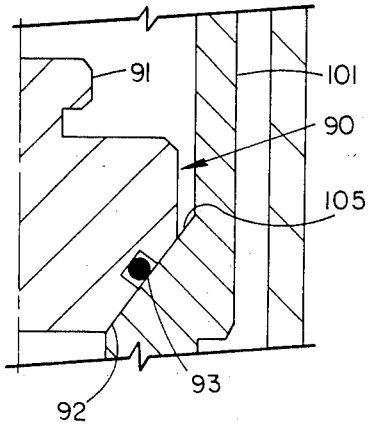
FIG. 4 is a partial, vertical sectional view of a modified removable plug valve.

The medial portion of the mandrel 101 is further provided with a plurality of radial ports 104. At the extreme bottom end of the mandrel 101, an internally sloped seating surface 105 is defined upon which a sealing ball 80 may be seated. Alternatively, as shown in FIG. 4, a plug-type valve 90 may be seated on seating surface 105. Plug valve 90 may be provided with a fishing neck 91 for convenient removal by wireline. A seal is provided by sloped surface 92 and O-ring 93 engaging sloped body surface 105.

An upper annular elastomeric mass 107 of sealing material is mounted below seal surface 105. An inner seal retainer 109 and the elastomeric mass 107 are secured to the bottom portion of the mandrel 101 by a retaining sleeve 108 which engages threads 101*a* provided on the upper tubular body portion 101. The upper elastomeric mass 107 will thus be seen to be surrounded on more than three of its faces to provide an annular, downwardly facing sealing surface 107*a* confined between metallic parts. An O-ring 101*b* seals the abutting end face connection between the inner retainer 109 and the bottom end of the mandrel 101. Valve 80 or 90, when positioned on sloped surface 105, prevents fluid from passing continuously through the bore of the mandrel 101 and the interconnected work string 3 in the downward direction.

The upper intermediate tubular body element 111 is spaced outwardly relative to the lower portions of the upper tubular body element 101 to define an annular fluid bypass 111*a* therebetween. Near the bottom of the threads 111*d*, the intermediate tubular body element 111 is provided with an internally projecting shoulder portion 111*b* defining a cylindrical bearing surface 111*c*. As will be later described, this bearing surface 111*c* slidably cooperates with an external cylindrical bearing surface 50*a* provided on a tubular shuttle valve 50. An O-ring seal 111*e* effects a seal with the bearing surface 50*a* of the shuttle valve 50 so that a fluid pressure chamber is defined by annular fluid bypass 111*a*.

The lower end of the third intermediate tubular body element 131 defines an internal cylindrical bearing surface 133 which slidably cooperates with the external cylindrical surface 51*a* of a seal support sleeve 51 which is secured to the shuttle valve 50. Additionally, the second and third tubular bodies 121 and 131 are provided with radial ports 125 and 126 to maintain the annulus 124 between the exterior of the shuttle valve 50 and the interior bore surface 123 of the intermediate body element 121 at the same fluid pressure as the casing annulus 1*a*.

A sealing sleeve 117 is slidably mounted within the internally projecting lower portion 131*b* of the third intermediate tubular body element 121 and is maintained in an upper position by a spring 118 acting against the bottom of the sealing sleeve 117 and an internal shoulder 143 defined just below the threads 131*e* providing the connection between intermediate body element 131 and the lower tubular body element 141. An enlarged shoulder 117*a* on the bottom of sealing sleeve 117 cooperates with an internally projecting, downwardly facing shoulder 131*c* provided on the intermediate tubular body element 131 to limit upward movement of sleeve 117. The top portion of the sealing sleeve 117 defines an upstanding beaded ridge 117*b* which functions as a sealing surface and cooperates with an annular elastomeric mass 55 provided on the bottom of the shuttle valve 50, in a manner to be hereinafter described. A seal 131*d*, having a smaller effective sealing diameter than O-ring 111*e*, seals the exterior of sealing sleeve 117 to the bore surface 131*a* of intermediate body portion 131.

A first seal support sleeve 51 (FIG. 2D) is mounted around the lower portions of the tubular body of the shuttle valve 50 and is secured in the desired axial position by a C-ring 52. The first seal support sleeve 51 is provided with a lower externally threaded portion 51*b* which cooperates with internal threads provided on a second seal retainer sleeve 53. A third seal support sleeve 54 is mounted on the bottom of shuttle valve 50 and sealed thereto by an O-ring 54*a*. The lower portions of concentric sleeves 53 and 54 are shaped to define a recess for receiving the annular elastomeric sealing mass 55, and retaining such mass in position to be engaged by the upstanding sealing ridge 117*b* whenever the shuttle valve 50 is moved downwardly. It should be noted that the annular sealing mass 55 is encompassed by metal, and only an annular portion 55*a* of the bottom radial face is exposed.

The upper end of the tubular shuttle valve 50 is provided with external threads 50*b* (FIG. 2B) and an internally threaded sealing sleeve 56 is secured thereto and the threaded connection is sealed by an O-ring seal 58. The sealing sleeve 56 is provided at its upper end with an upstanding annular ridge sealing member 56*a* which cooperates with the exposed downwardly facing annular portion 107*a* of the annular elastomeric mass 107 to achieve a sealing engagement therewith whenever the shuttle valve 50 is in its uppermost position, as illustrated in FIG. 2B. The outer upwardly facing surfaces of shuttle valve 50 and sleeve 56 constitute piston surfaces disposed in the annular fluid bypass 111*a*.

Shuttle 50 is resiliently biased to remain in its uppermost position by a helical spring 60 which surrounds the medial portion of the tubular shuttle valve 50 and abuts at its upper end against a ring 61 which in turn abuts against a downwardly facing shoulder 50*c* provided on the tubular shuttle valve 50. At its lower end, spring 60 abuts a ring 62 which is supported by a plurality of spacer rings 63. The number of spacer rings employed and the axial height of each depends upon the amount of pressure that is selected to maintain the shuttle valve in its closed upper position with respect to the downwardly facing elastomeric seal surface 107*a*. Spacer rings 63 are in turn supported on an upwardly facing shoulder 131*c* provided on the intermediate tubular body portion 131.

As previously mentioned, the valving apparatus 10 embodying this invention is series connected between the tubular work string 3 and a downhole tool, such as a perforation washing tool 20. This invention may be advantageously employed in other applications including with any type of downhole tool wherein a fluid pressure actuated expandable packing element is expanded into sealing engagement across the annulus 1*a*. The washing tool 20 illustrated in the drawings is entirely conventional, and may, for example, comprise a Model C Packing Element Circulating Washer sold by Baker Service Tools Division of BAKER OIL TOOLS, INC. Accordingly, no detailed description of the construction of such tool will be made and reference may be had to our aforementioned parent application Ser. No. 535,409, filed 9/26/83, for further details.

In a well where the hydrostatic casing annulus fluid pressure is equal to the hydrostatic pressure existing in the bore of the inner conduit, the washing operation can be discontinued and the elastomeric packing elements (not shown) of washer 20 released simply by terminating the application of the fluid pressure to the work string. However, in those wells having a low fluid level, it often happens that the hydrostatic fluid pressure of the column of fluid contained in the interconnected work string and wash tool is substantially in excess of the ambient hydrostatic pressure existing in the casing annulus. In such event, it is not possible to effect the release of the expansible elastomeric packing elements merely through reduction of the fluid pressure in the work string 3. The valving apparatus 10 involving this invention is specifically directed to resolving this problem, and it operates in the manner hereinafter described.

OPERATION

During run-in of the interconnected washing apparatus 20, valving apparatus 10 and work string 3, fluid communication is maintained between the annulus surrounding the fluid transmission conduit, or work string 3 and the bore 20*a* through the open annular port or gap 118 defined between sealing sleeve 117 and the annular elastomeric seal 55. Shuttle valve 50 remains in the position shown in FIGS. 2B and 2C because of the action of spring 60.

Figure 2A:
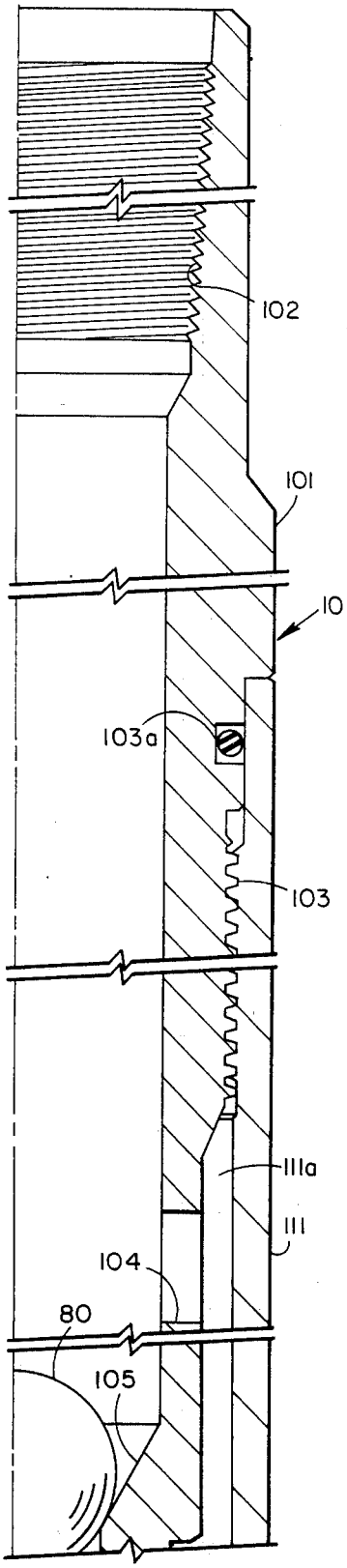
FIGS. 2A–2D collectively constitute an enlarged scale, quarter sectional view of the valving apparatus shown in FIG. 1, with the elements thereof shown in their run-in position.
Figure 2B:
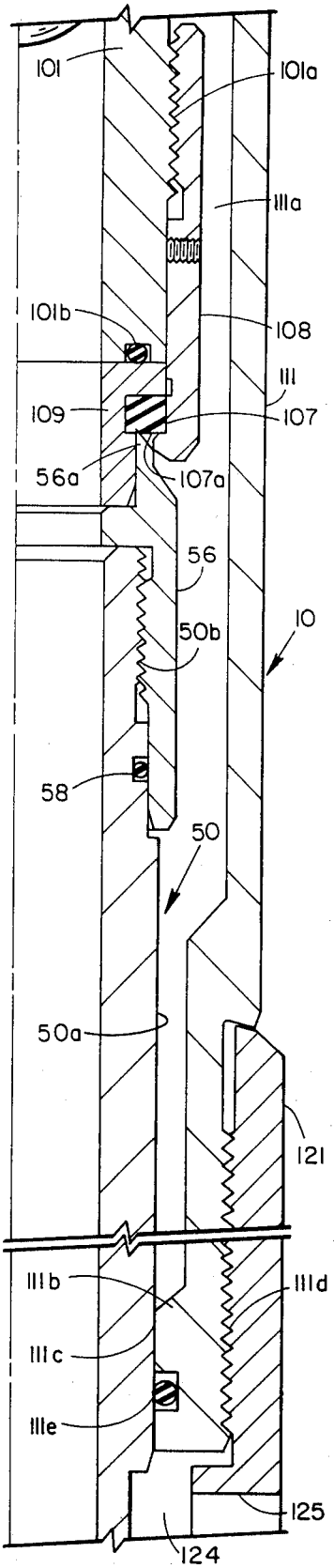
Figure 2C:
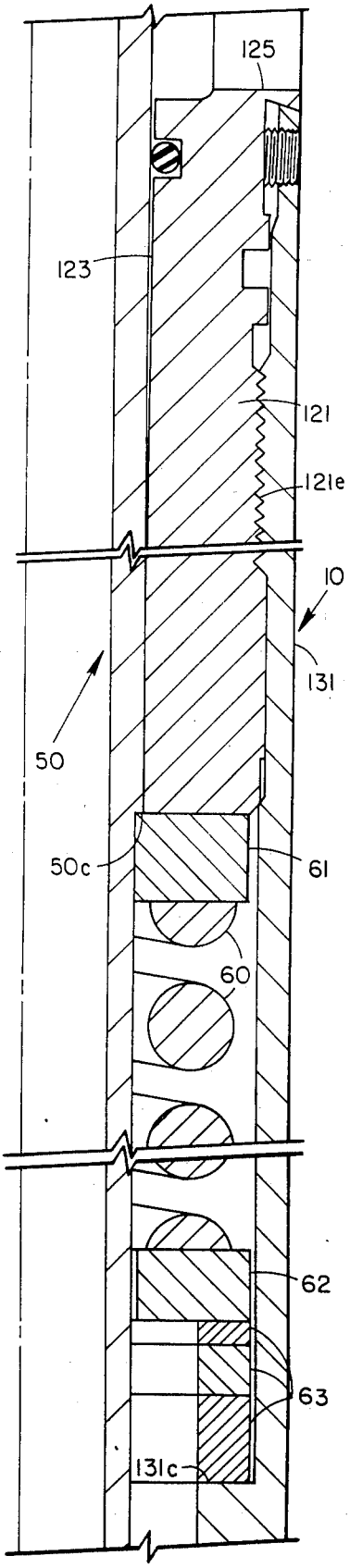
Figure 2D:
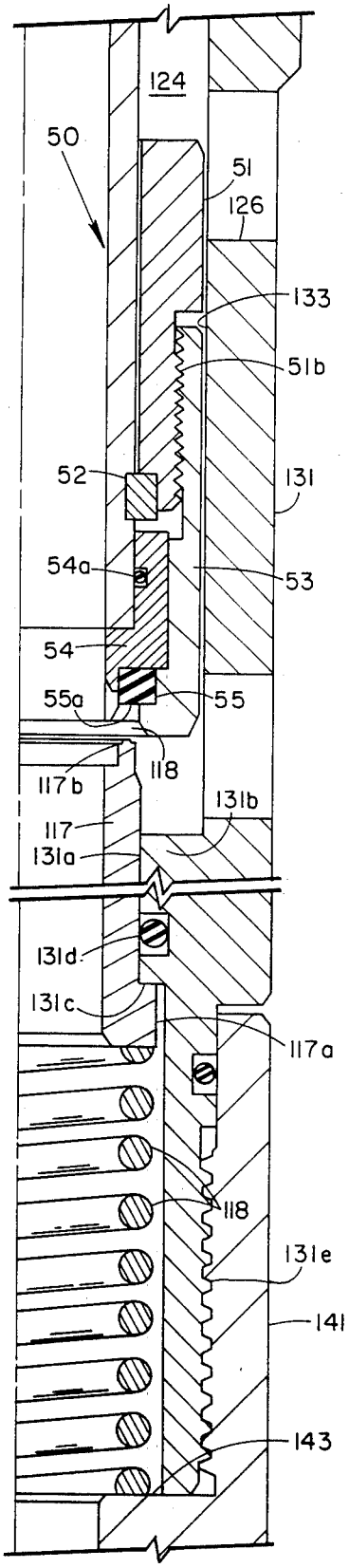

When the washing apparatus 20 or other apparatus incorporating a fluid pressure expansible packing element is positioned at its desired downhole location, the elements of the apparatus will be in their positions shown in FIGS. 2A–2C. The removable ball valve 80 or plug valve 90 may be inserted through conduit 3 into sealing relationship with the seat 105. Fluid pressure above the seat 105 can then be increased at the well head and such increased fluid pressure flows outwardly through the radial port 104 into annular fluid bypass 111*a*, which is then a closed chamber because shuttle valve 50 is in its closed, upward position. Such fluid pressure acts on the upwardly facing outer surfaces of the shuttle valve 50 and sleeve 56. There is a greater area of upwardly facing surfaces on such elements than downwardly facing surfaces exposed to the higher fluid pressure flowing into fluid bypass 111*a* due to the larger effective sealing diameter of O-ring 111*e*. When the fluid pressure in bypass 111*a* is increased sufficiently, the sleeve 56 and shuttle valve 50 are forced downwardly. Such downward movement against the action of spring 60 effects the opening of the sealing engagement between the upstanding annular sealing ridge 56*a* on shuttle valve 50 and the annular elastomeric mass 107, thus permitting the pressured fluid to flow within the bore of the tubular shuttle valve 50 below ball 80. Concurrently, the annular elastomeric mass 55 mounted on the bottom end of the shuttle valve 50 is moved into sealing engagement with the upstanding sealing ridge 117*b* provided in the lower portions of the lower intermediate body element 121.

Thus the increased fluid pressure is applied through the bore of the tubular shuttle valve 50 into the bore of the intermediate body element 131, thence, into the bore of the lower tubular body element 141, and into the bore of the washing tool 20 to effect the expansion of the elastomeric packing elements (not shown) conventionally carried by the washing tool 20. The washing operation then proceeds in normal manner with an appropriate fluid. It should be noted that once the shuttle valve 50 is displaced downwardly enough to engage sealing ridge 117*b*, the fluid pressure in fluid bypass 111*a* is acting on the differential area defined by O-rings 111*e* and 131*d*, which provides more than sufficient force to firmly hold shuttle valve 50 in its lower position illustrated in FIGS. 3B, 3C, and 3D. Continuous metering of flow past upper sealing ridge 56*a* and annular elastomeric mass 107 is thus prevented, and once shuttle valve 50 moves downwardly, a larger bypass flow area is provided for the pressured fluid.

It should further be noted that the seals provided on each end of shuttle valve 50 are unusually efficient. They are friction free, sturdy, and can withstand repeated opening with a substantial pressure differential across the seal.

Figure 3D:
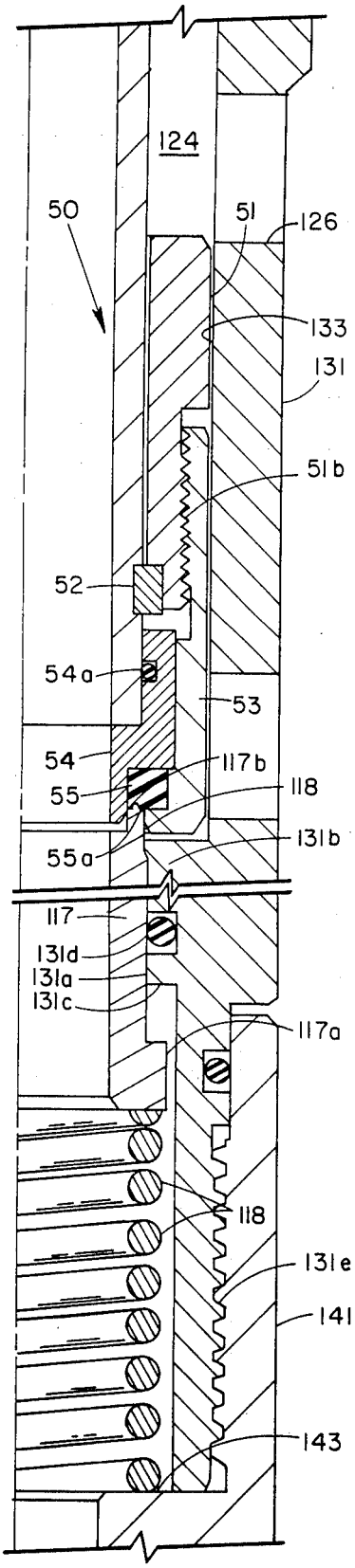
FIGS. 3A–3D are views respectively similar to views 2A–2D but showing the elements of the valving apparatus in their operative positions when pressured fluid is supplied to the perforation washer through the valving apparatus.
Figure 3A:
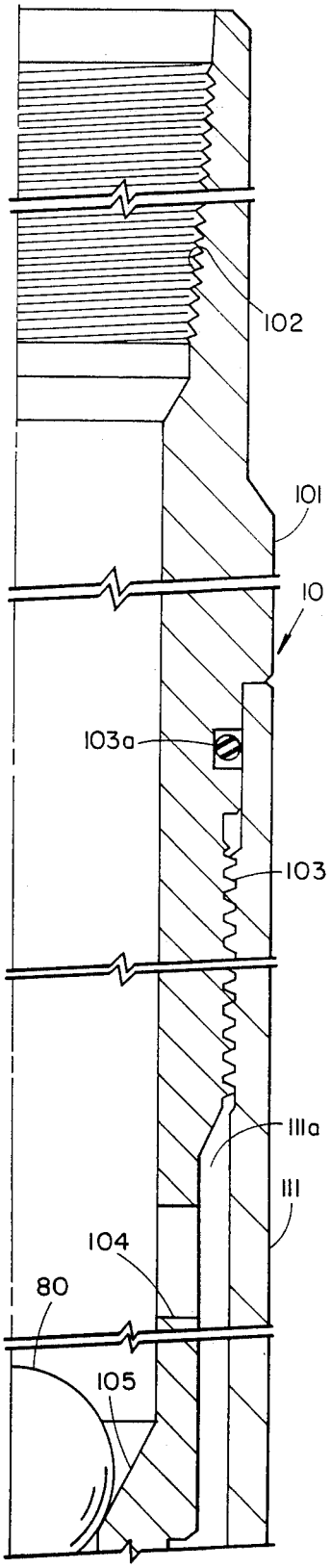
Figure 3B:
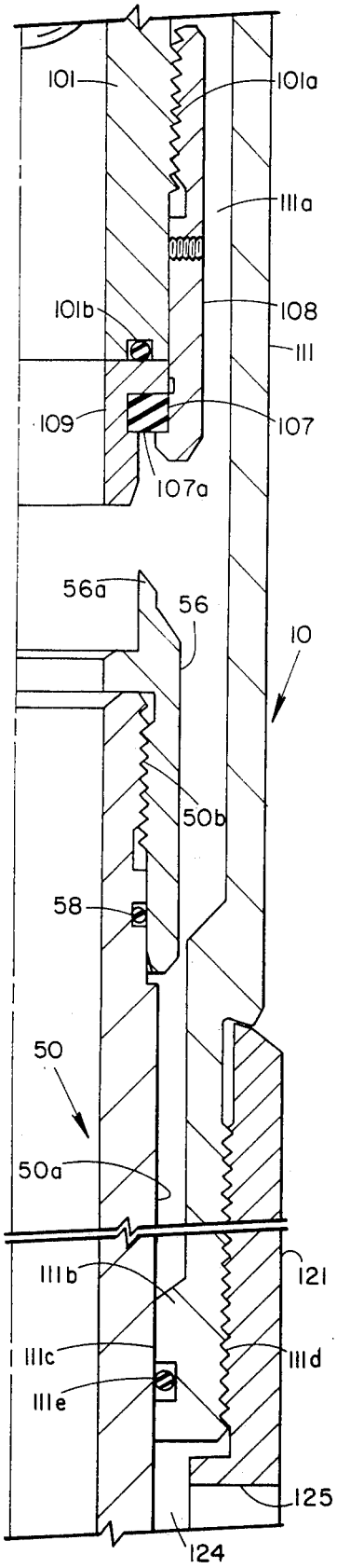
Figure 3C:
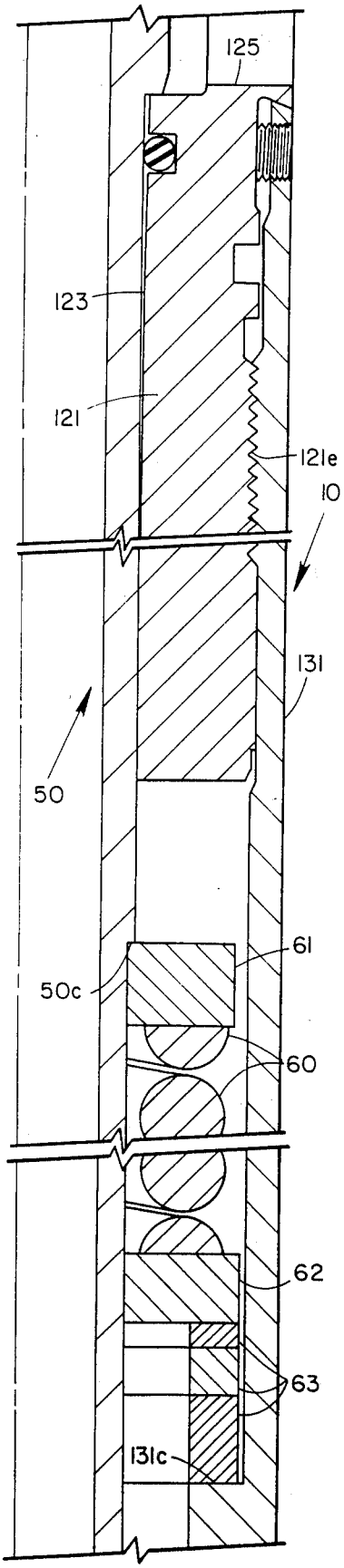

At the conclusion of the washing operation, the fluid pressure is removed at the surface from the bore of the work string 3, and the fluid pressure in the valve apparatus 10 acting to maintain shuttle valve 50 in the position of FIGS. 3B, 3C, and 3D returns to the normal hydrostatic pressure represented by the column of fluid contained in the work string 3 and the interconnected valving apparatus 10. The effective downward force on sleeve element 56 and shuttle valve 50 is thus removed and hence the shuttle valve 50 returns to its uppermost position, as illustrated in FIG. 2B, wherein the annular sealing ridge 56*a* is in sealing engagement with the exposed annular portion 107*a* of annular elastomeric mass 107. More importantly, the annular gap 118 is concurrently opened between the lower annular elastomeric sealing element 55 and the upstanding sealing ridge 117*b*. This gap permits a ready flow of fluid contained within the interconnected bore of the valving apparatus 10 and the work string 3 below valve seat 105 through such gap, through the radial ports 126, and into the casing annulus 1*a*, thus equalizing the fluid pressure in the casing annulus with that existing in the bore of the interconnected washing apparatus 20 below the valve seat 105. The pressure in the annulus acting on the elastomeric packing elements of washer 20 is thus equal to the pressure in the bore of washer 20 acting to maintain the elements in their expanded configuration. This equalization of pressure permits the annular elastomeric packing elements of washer 20 to contract through their normal resilience and return to their run-in positions.

It is therefore apparent that a valving apparatus embodying this invention provides a reliable supply of pressured fluid to any pressure-actuated downhole tool disposed below the valving apparatus or for use in any downhole operation. At the same time, equalization of casing annulus pressure with the pressure contained in the bore below the valve seat 105 and closed shuttle valve 50 can be effected at any time that the fluid pressure in the interconnected work string, above the valve seat 105 is sufficiently reduced. Moreover, the ball valve 80 can be removed from seat 105 by reverse circulation, or plug valve 90 removed by wireline, leaving the bore of the valving apparatus 10 open for production flow or insertion of other tools.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirt of the described invention.

What is claimed and desired to be secured by the Letters Patent is:

1. A valve for effecting the sealing of an annular opening defined between an end of a tubular conduit and a first sleeve mounted for axial movements relative to said end of said tubular conduit, comprising: an annular mass of elastomeric material; means supporting said annular mass in sealed concentric relationship to said end of said tubular conduit, said supporting means engaging all external surfaces of said annular mass of elastomeric material except for an annular portion of one radial face; and an annular sealing rib on one end of said first sleeve embeddable in said annular portion of said one radial face of said annular elastomeric mass by axial movement of said first sleeve relative to said end of said tubular conduit; a second tubular conduit secured to said first mentioned tubular conduit in surrounding relationship to said first sleeve and defining an annular fluid pressure chamber having the exterior of said first sleeve constituting the inner wall thereof; said annular sealing rib constituting a wall portion of said fluid pressure chamber; a lower annular seal disposed between the exterior of said first sleeve and the bore wall of said second tubular conduit; said lower annular seal being of larger diameter than said annular sealing rib; and means for supplying pressured fluid to said fluid pressure chamber, thereby exerting a fluid pressure force on said first sleeve to move said first sleeve axially to an open position to disengage said annular sealing rib from said elastomeric mass to transmit pressured fluid into the bore of said first sleeve.

2. A valve in accordance with claim 1 further comprising a second annular elastomeric mass secured to the other end of said first sleeve; a second sleeve slidably and sealably secured to said second tubular conduit; resilient means urging said second sleeve axially toward said second annular elastomeric mass; and an annular sealing ridge formed on said second sleeve and embeddable in said second annular elastomeric mass by said fluid pressure produced movement of said first sleeve.

3. A valve in accordance with claim 2 wherein said second annular elastomeric mass is secured to said other end of said first sleeve by concentric inner and outer rigid retaining sleeves surrounding all faces of said second annular elastomeric mass except an annular portion of one radial face, said annular portion being engagable by said annular sealing ridge; and at least one of said inner and outer sleeves being secured to said other end of said first sleeve.

4. A valve in accordance with claim 2 further comprising resilient means opposing said fluid pressure produced movement of said first sleeve; and a lowermost annular seal operating between the exterior of said second sleeve and the interior bore of said second conduit to prevent fluid flow therethrough when said second annular elastomeric mass is engaged by said annular sealing ridge, said lowermost annular seal having a smaller effective diameter than said lower annular seal, thereby holding said first sleeve in said open position.

5. A valve in accordance with claim 3 further comprising resilient means opposing said fluid pressure produced movement of said first sleeve; and a lowermost annular seal operating between the exterior of said second sleeve and the interior bore of said second conduit to prevent fluid flow therethrough when said second annular elastomeric mass is engaged by said annular sealing ridge, said lowermost annular seal having a smaller effective diameter than said lower annular seal, thereby holding said first sleeve in said open position by the pressured fluid.

6. A valve in accordance with claim 5 wherein said means for supplying fluid pressure to said fluid pressure chamber comprises a valve seat in said first-mentioned tubular conduit; a removable valve seated on said valve seat; and port means in said first-mentioned conduit above said valve seat and communicating with said annular fluid pressure chamber.

7. Fluid pressure responsive valving apparatus for use with an annular downhole tool having a packing element responsive to a pressure differential between the bore of the tool and the surrounding annulus within the well bore, comprising; a tubular assembly connectable in series relation between a surface-connected well conduit and the downhole tool; removable plug means for closing said tubular assembly for permitting fluid pressure within said tubular assembly to be increased; a valve mounted in said tubular assembly and shiftable from a first position to a second position in response to increased fluid pressure within said tubular assembly; said valve in said first position connecting the bore of said tubular assembly to the annulus; resilient means urging said valve to said first position; said valve in said second position directing conduit fluid pressure into the bore of the downhole tool to expand the packing element thereof; and means responsive to the conduit fluid pressure for shifting said valve to said second position against the bias of said resilient means.

8. Valve apparatus for use in a fluid transmission conduit in a subterranean well in which fluids move through the conduit in one direction, the fluids moving in the opposite direction being directed to the exterior of the conduit, comprising: a mandrel having a bore communicating with said conduit; removable plug means for closing said mandrel to prevent the passage of fluids in said one direction therethrough; fluid bypass means communicable with said conduit on opposite sides of said plug means; port means communicable between said conduit and the fluid bypass means exterior of said conduit; and a shuttle valve shiftable relative to said mandrel between a first and a second position, said shuttle valve closing communication through said fluid bypass means in said first position and closing said port means and opening communication between the bypass passage and the conduit in said second position, said shuttle valve being responsive to the pressure differential above and below said plug means, whereby said shuttle valve is shiftable to the second position to allow flow through said conduit and fluid bypass means in said one direction only and is shiftable to said second position to allow flow in the opposite direction on the exterior of said conduit.

9. Valve apparatus permitting movement of fluid through a tubular conduit in a subterranean well in a first direction, said valve comprising: an outer housing; an inner mandrel having a bore therethrough, a portion of the inner mandrel being shiftable relative to said housing; removable plug means closing the bore of the non-shiftable portion of said inner mandrel and preventing fluid from passing through the mandrel in one direction, a fluid bypass between said housing and said mandrel communicable with the mandrel bore on opposite sides of said plug means; means on said shiftable portion of said mandrel for moving said shiftable mandrel portion in a first direction in response to fluid pressure in said fluid bypass; first valve means opening upon movement of said shiftable mandrel portion in a first direction for establishing communication between said mandrel bore and said fluid bypass on one side of said plug means; and second valve means on the opposite end of said shiftable mandrel portion for establishing communication bewteen said mandrel bore and the exterior of said housing, said second valve means being closed when said first valve means is open and open when said second valve means is closed.

10. The valve apparatus of claim 9 further comprising biasing means opposing movement of said shiftable mandrel portion in said first direction.

11. The valve apparatus of claim 10 wherein said first valve means is shiftable relative to said plug means, said first valve means and said plug means defining a restricted flow passage during an initial interval of movement of the first valve means, the flow past said first valve means being increased during a subsequent interval of movement of the first valve means.

* * * * *